US006592008B2

(12) United States Patent
Dion

(10) Patent No.: US 6,592,008 B2
(45) Date of Patent: Jul. 15, 2003

(54) DISPENSER APPARATUS

(76) Inventor: Mario Dion, 1645 des Merisiers, Ste-Catherine, Quebec (CA), J0L 1E0

( * ) Notice: Subject to any disclaimer, the term of this patent is extended or adjusted under 35 U.S.C. 154(b) by 127 days.

(21) Appl. No.: 09/826,061

(22) Filed: Apr. 4, 2001

(65) Prior Publication Data

US 2001/0042759 A1 Nov. 22, 2001

Related U.S. Application Data

(63) Continuation-in-part of application No. 09/375,958, filed on Aug. 17, 1999, now abandoned.
(60) Provisional application No. 60/096,786, filed on Aug. 17, 1998.

(51) Int. Cl.[7] ..... B67D 5/52
(52) U.S. Cl. ..... 222/135; 222/144.5
(58) Field of Search ..... 222/108, 132, 222/135, 144.5

(56) References Cited

U.S. PATENT DOCUMENTS 4,962,866 A * 10/1990 Phillips ..... 222/132
5,497,914 A * 3/1996 Maltsis ..... 222/144.5
5,735,589 A * 4/1998 Herrmann et al. ..... 312/408

* cited by examiner

*Primary Examiner*—Philippe Derakshani
(74) *Attorney, Agent, or Firm*—Eric Fincham

(57) ABSTRACT

In automobile dealerships having a service department and wherein a plurality of flowable products in bulk containers are used, there is an improvement which comprises a storage and dispensing device which has a cabinet with a plurality of shelves thereon, the bulk containers being placed on the shelves, a plurality of dispensing outlets located in a wall of the cabinet, a plurality of individual pumping devices with first conduits extending between each bulk container in respect of one of the pumping devices and second conduits extending between each of the pumping devices and a respective dispensing outlet. The arrangement provides for control of cleaning chemicals and prevents waste thereof.

3 Claims, 2 Drawing Sheets

DISPENSER APPARATUS

This application is a continuation-in-part of Ser. No. 09/375,958 Aug. 17, 1999 now abandoned and claims benefit of No. 60/096,786 Aug. 17, 1998.

FIELD OF THE INVENTION

The present invention relates to a dispensing system and more particularly, relates to a dispensing apparatus suitable for dispensing cleaning chemicals for automotive purposes.

BACKGROUND OF THE INVENTION

In many automobile dealerships, a number of cleaning operations are required during the course of a day. In order to meet this requirement, a typical dealership must normally stock in excess of eight types of chemicals required for specific cleaning purposes. Normally, these cleaning chemicals are maintained in some type of store room and access is freely granted to employees who might need to use the same.

The cost associated with the use of such cleaning chemicals is normally regarded as a "cost of doing business". However, I have found that the cost associated with the cleaning chemicals is substantially higher than required and that the costs can be reduced substantially by providing a system to control usage of the same. Indeed, it is possible to turn the operation into a profit centre for the automobile dealership.

There is a substantial loss associated with the use of these cleaning chemicals which typically come in bulk containers. According to my development, there is provided a dispensing system to control the usage and wastage of such chemicals.

SUMMARY OF THE INVENTION

It is an object of the present invention to provide a method for controlling costs and inventory in a service department of an automobile dealership wherein a plurality of flowable products in bulk containers are used for servicing a vehicle.

It is a further object of the present invention to provide a storage and dispensing device for use in an automobile dealership having a service department.

According to a first aspect of the present invention, there is provided an improvement in an automobile dealership having a service department and wherein there are a plurality of flowable products in bulk containers for use within the service department, the improvement comprising a storage and dispensing device, the storage and dispensing device comprising a cabinet having a plurality of shelves therein, the bulk containers being placed within the cabinet on the shelves, a plurality of dispensing outlets located in a wall of the cabinet, a plurality of individual pumping means, first conduit means extending between each bulk container and a respective one of the pumping means and second conduit means extending between each one of the pumping means and a respective dispensing outlet.

In a further aspect of the present invention, there is provided a method of controlling costs and inventory in a service department of an automobile dealership wherein a plurality of flowable products in bulk containers are used for servicing a vehicle, the method comprising the steps of installing a cabinet having a plurality of shelves therein, for receiving the bulk containers, a plurality of dispensing outlets being located in a wall of the cabinet, a plurality of individual pumping means, first conduit means extending between each bulk container and a respective one of the pumping means and second conduit means extending between each one of the pumping means and a respective dispensing outlet, placing the bulk containers on the shelves and restricting access to the bulk containers, and permitting the dispensing of individual predetermined portions of the products from the bulk containers.

The storage and dispensing device preferably has drainage outlets situated below the dispensing outlets and a drainage container located below the drainage outlet for collecting any spillage of any of any of the products after they have been dispensed or during the dispensing process.

There is preferably provided a control button adjacent each dispensing outlet, each control button being operatively connected to a respective pumping means to operate the pumping means to dispense a predetermined portion. It will be understood that the control means for doing so are well known in the art and that the pumping means may be operated for a predetermined period of time to dispense the predetermined portion.

In a preferred embodiment, the pumping means comprises a pump and an electric motor of the type well known in the art.

The cabinet itself is preferably arranged to provide a suitable locking mechanism and there are also provided vent means in an upper portion of the cabinet.

In a preferred embodiment, the cabinet is provided with a pair of doors with a first one of the doors having the dispensing outlets therein and a second one of the doors providing access to a storage portion of the cabinet. There may be provided an arrangement wherein the shelves are slidably mounted within the cabinet.

The dispensing system of the present invention will utilize a pumping system for each type of chemical and provides for easy access to the bulk containers. Since each chemical can have deleterious effects on various conduits and the like, each conduit and associated pump must be designed to have components resistant to the particular chemical.

Examples of typical chemicals which may be employed are windshield cleaner, plastic cleaners, metal cleaners, engine cleaners, rim cleaners, etc.

In a preferred aspect of the method of the present invention, each technician in the shop is assigned a tool kit and key to access the dispenser. A log is kept of all uses and the cost of the materials is charged to each technician. By so doing, Management is able to identify the return for each of the technicians.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figures 1, 2:
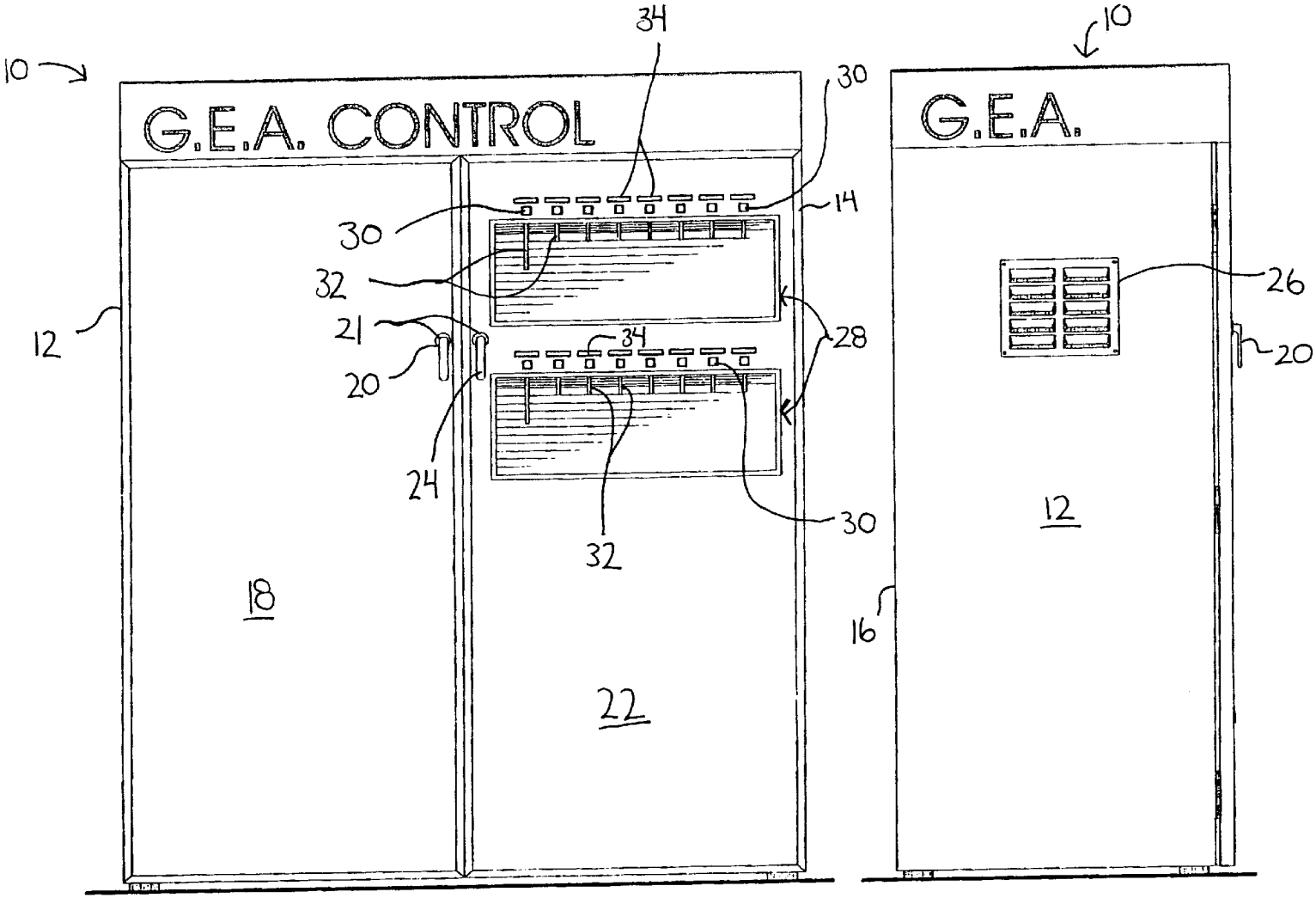
FIG. 1 is a front elevation view of a dispensing system according to the present invention.
FIG. 2 is a side elevational view thereof.

Referring to the drawings in greater detail and by reference characters thereto, there is illustrated a dispensing system which is generally designated by reference numeral 10.

Dispensing system 10 is comprised of a cabinet having a side wall 12, a second side wall 14, a back wall 16, a ceiling 17, a left side door 18 having handle 20 thereon, and a right side door 22 having a handle 24. Locks 21 are provided in handles 18, 24. A vent 26 is provided in side wall 12.

As may be seen in FIG. 1, there is provided a recessed portion 28 into which containers may be inserted to receive a chemical from one of the dispensing conduits 32. A button 30 is provided for each dispensing conduits 32 as well as a corresponding label 34. Buttons 30 are operative to dispense predetermined portion of the chemical.

Figure 3:
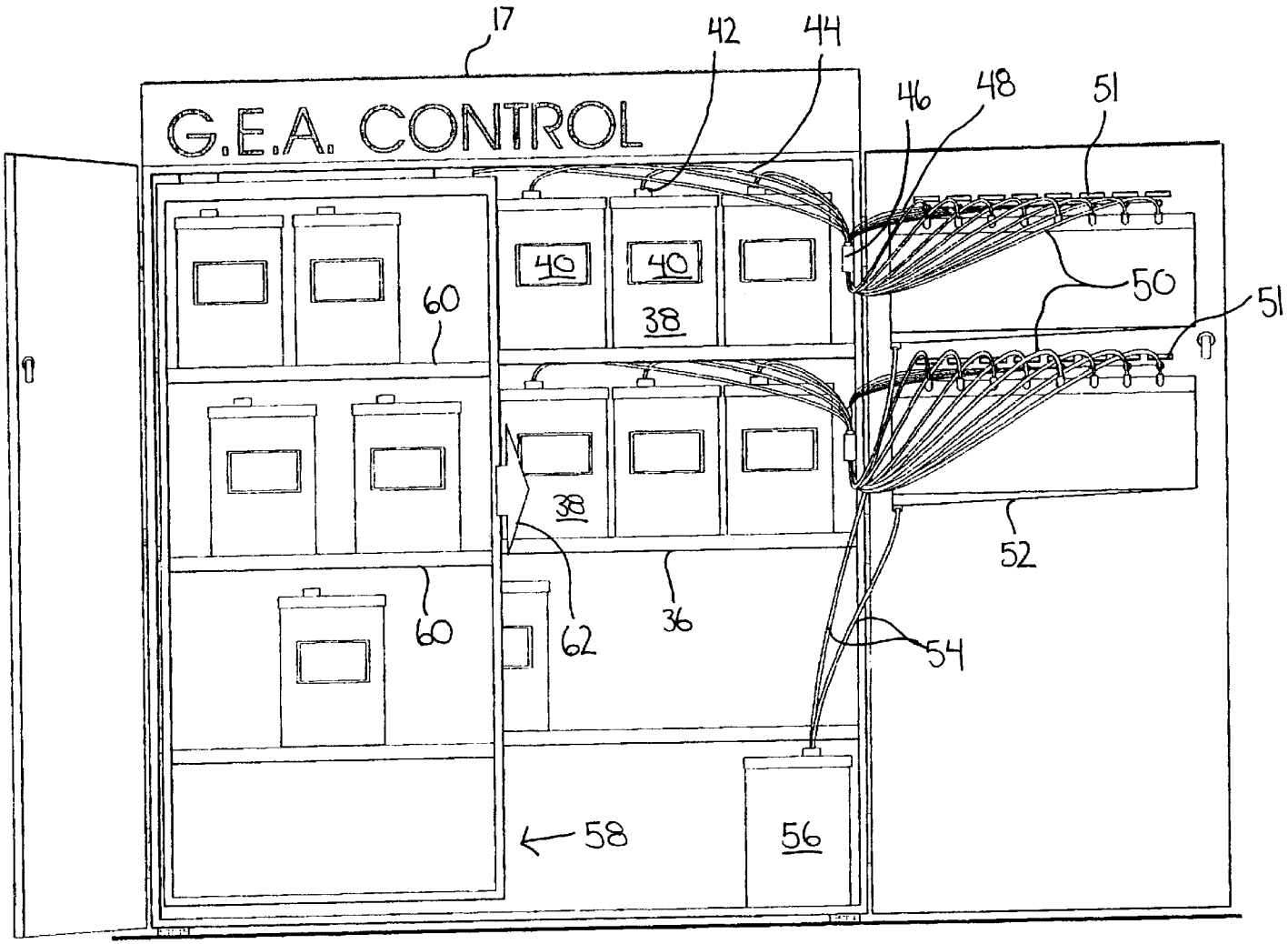
FIG. 3 is a front elevational view with the doors being in an open position.

As seen in FIG. 3 with the doors 18 and 22 in an open position, there are provided back shelves 36 which are designed to receive bulk containers 38 each having a label 40 thereon to identify the particular cleaning chemical. Each bulk container 38 includes a dispensing outlet 42 into which is placed a conduit 44.

Conduit 44 are in fluid communication with the liquid within containers 38 and lead to a plurality of electric motors 46; there is an electric motor 46 provided for each conduit 44 and associated container 38. From electric motor 46, the liquid may be pumped by means of a tube 50 to dispensing conduit 32. Wires 48 lead from electric motor 46 to associated button 30.

As may been seen in FIG. 3, each recessed portion 28 has a sloping bottom wall 52 which leads to drain tubes 54. In turn, drain tubes 54 permit any spilled liquid to drain to a container 56.

For storage purposes, there is provided a storage module 58 which is mounted forwardly of shelves 36. Storage module 58 includes shelves 60 for receiving and storing containers and is slidable as indicated by arrows 62 to permit access to containers 38 situated rearwardly thereof.

As will be seen from the above description, there is provided a dispensing system which is convenient to use and overcomes the problems of the prior art.

It will be understood that the above described embodiment is for purposes of illustration only and that changes and modifications may be made thereto without departing from the spirit and scope of the invention.

I claim:

1. A method of controlling costs and inventory in a service department of an automobile dealership wherein a plurality of flowable cleaning products in bulk containers are used for cleaning a vehicle, the method comprising the steps of:

installing a cabinet having a plurality of shelves therein for receiving said bulk containers, a plurality of dispensing outlets being located in a wall of said cabinet, an individual pumping means associated with each of said dispensing outlets, first conduit means extending between each bulk container and a respective one of said pumping means and second conduit means extending between each one of said pump means and a respective dispensing outlet;

placing said bulk containers on said shelves and restricting access to said bulk containers;

permitting the dispensing of individual predetermined portions of said products from said bulk containers; and maintaining a log of each use of said cleaning products by a technician.

2. The method of claim 1 further including the step of providing drainage outlets in below said dispensing outlets to collect spillage.

3. The method of claim 1 wherein the step of installing said cabinet includes installing a cabinet having control buttons adjacent each dispensing outlet, each control button being operatively connected to a respective pumping means to operate said pumping means to dispense said predetermined portion.

* * * * *